US009599432B2

(12) United States Patent
Neville

(10) Patent No.: US 9,599,432 B2
(45) Date of Patent: Mar. 21, 2017

(54) UNIVERSAL MOUNT FOR FOLDING BAYONET

(71) Applicant: Steven Neville, Kimberly, WI (US)

(72) Inventor: Steven Neville, Kimberly, WI (US)

( * ) Notice: Subject to any disclaimer, the term of this patent is extended or adjusted under 35 U.S.C. 154(b) by 44 days.

(21) Appl. No.: 15/044,504

(22) Filed: Feb. 16, 2016

(65) Prior Publication Data

US 2016/0349006 A1 Dec. 1, 2016

Related U.S. Application Data

(60) Provisional application No. 62/166,656, filed on May 26, 2015.

(51) Int. Cl.

| | |
|---|---|
| ***F41A 15/00*** | (2006.01) |
| ***F41C 27/18*** | (2006.01) |
| ***F41G 11/00*** | (2006.01) |

(52) U.S. Cl.

CPC ..... *F41C 27/18* (2013.01); *F41G 11/003* (2013.01)

(58) Field of Classification Search

CPC ..... F41C 27/18; F41C 27/16
USPC ..... 42/90, 93
See application file for complete search history.

(56) References Cited

U.S. PATENT DOCUMENTS

| | | | | |
|---|---|---|---|---|
| 2,098,139 | A | 4/1937 | Henning et al. | |
| 4,571,870 | A | 2/1986 | Heideman et al. | |
| 6,289,621 | B1 | 9/2001 | Vendetti et al. | |
| 6,385,892 | B1 | 5/2002 | Vendetti | |
| 6,725,593 | B1 * | 4/2004 | Harris | F41C 27/18 42/86 |
| 6,968,642 | B1 * | 11/2005 | Leung | F41C 23/16 30/162 |
| 9,127,904 | B2 | 9/2015 | Moore, Jr. | |
| 9,341,442 | B1 * | 5/2016 | Geissele | F41C 27/18 |
| 2010/0101095 | A1 | 4/2010 | Prasetya | |
| 2014/0033593 | A1 | 2/2014 | Moore, Jr. | |
| 2014/0215887 | A1 * | 8/2014 | Luckey | F41G 11/003 42/90 |

OTHER PUBLICATIONS

Fairefield Rifle Knife Bayonet with Barrel Mount, Sep. 27, 2016, http://www.rakuten.com/prod/firefield-rifle-knife-bayonet-with-barrel-mount.*

Laserlyte Pistol Bayonet Line, Sep. 27, 2016, http:www.tactical-life.com/gear/laserlyte-pistol-bayonet-line/.*

* cited by examiner

*Primary Examiner* — J. Woodrow Eldred
(74) *Attorney, Agent, or Firm* — Robert Gray

(57) ABSTRACT

A picatinny/weaver style mount for a folding bayonet provides a cradle with set screws, for affixing the folding bayonet to the mount. The mount can be affixed to any picatinny/weaver style rail that is on the barrel of a rifle, automatic weapon, shotgun, or other long firearm. Below the cradle, is a rail mount that provides a main bolt for the mount, which may be secured with an Allen wrench and released with one hand. On the left side and the right side of the mount, picatinny rails are provided for securing a flashlight, sighting laser, bipod, or other attachments.

19 Claims, 3 Drawing Sheets

UNIVERSAL MOUNT FOR FOLDING BAYONET

CROSS-REFERENCE TO RELATED APPLICATIONS

This Application claims the benefit of U.S. Provisional Application No. 62/166,656, filed May 26, 2015, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to accessories for firearms and in particular to a universal mount for a folding bayonet. The folding bayonet has been in use by the world's infantry forces since before World War II. More recently, although the bayonet is rarely used for its original purpose, a variety of other attachments have been developed for rifles and other long firearms used by infantry, special operations forces, and tactical police units. The attachments have included flashlights, lasers for sighting purposes, and bipods. Unfortunately, each of these attachments has been developed with its own mounting hardware, and few have been designed with the goal of rapidly affixing multiple attachments without using any tools.

Bayonet lug clamp and mounting assembly, U.S. Pat. No. 9,127,904 (priority May 31, 2000), provides a lug clamp and mount assembly for use with a rifle having a T-shaped bayonet lug, with slots formed in a central portion thereof. A housing is configured to slidingly engage the bayonet lug. A lever incorporating an accessory mounting rail is pivotally coupled to the housing for movement towards and away therefrom. A jaw is movably mounted in the housing and has teeth that are aligned with the slots in the bayonet lug when the housing is slid thereon. A piston/cylinder assembly is coupled to the lever and to the jaw. When the lever is pivoted towards the housing, with the teeth aligned with the slots in the bayonet lug, the piston/cylinder assembly presses the jaw against the bayonet lug as the teeth engage the slots.

Bayonet lug to picatinny rail adaptor, U.S. Pat. No. 6,385,892 (priority Jul. 11, 2013), provides an adaptor which allows accessories to be mounted to the bayonet lug rather than a Picatinny rail mounted to the hand guard of a rifle. The adaptor of the present invention allows accessories to be used while not interfering with the proper grip on the hand guard and without the need to replace the hand guard with one that has an integrated Picatinny rail.

Bayonet lug clamp, U.S. Pat. No. 6,289,621 (priority Oct. 20, 1999), provides a bayonet lug clamp with a housing opened on one end thereof for slidingly engaging the bayonet lug. A plate is mounted in the housing and opposes the bayonet lug as the housing is slid thereon. A screw passes through the housing to threadably engage the plate. Turning of the screw draws the plate against the bayonet lug.

Quick release mount for firearm aiming device, U.S. Pat. No. 4,571,870 (priority Oct. 24, 1983), provides a quick release mount for securing an aiming device, such as a laser, on the barrel of a rifle. The device includes a forward and rear mount, shiftably mounted on a base plate to which the aiming device is permanently secured. The forward mount includes a spring-loaded slide member slideably mounted on the base plate and a split ring secured to the slide member, which is sleeved over the barrel and biased into sliding engagement with a stop member on the barrel, such as a flame arrester. The rear mount includes a body member provided with slots and a locking mechanism for releasably receiving a shoe, which is permanently secured to the barrel.

Knife/bayonet device including rapid attachment, shoot through bayonet unit, U.S. Pat. No. 6,725,593 (priority Oct. 23, 2002), provides a knife/bayonet device which is useful as both a knife and as a bayonet adapted to be mounted on a barrel portion, e.g., muzzle brake, of a rifle having a groove therein. The device includes an integral knife/bayonet component including a hollow handle portion and a blade. The handle portion is adapted to fit onto the barrel portion of the rifle and includes a locking groove having an opening therein extending through the handle portion. A locking ring received in the locking groove includes a detent portion adapted to extend through the opening in the locking groove to engage in the groove in the barrel portion of the rifle and thereby secure the knife/bayonet component to the rifle. A multi-purpose butt cap is adapted to be received in one end of the handle portion, and a storage canister is adapted to be affixed to the butt cap.

Gun and hunting knife combination, U.S. Pat. No. 2,098,139 (priority Apr. 22, 1937), provides a combination wherein a hunting knife is carried within the confines of a gun stock for ready removal when desired for use. A bore or recess is drilled or otherwise provided longitudinally of a gun stock, being open at the butt end of the latter. A hunting knife is adapted to be removably disposed within the bore or recess. The free end of the blade is adapted to engage in the bifurcation well of a slidable follower of wood or any other suitable material with which the blade is adapted to contact to avoid injury or metal to metal contact. The follower is cushioned by an expansive coil spring which is fastened to the follower and to a disk, removably or permanently fastened in the bore as preferred.

Tactical knife, U.S. Patent App. Pub. No. US2010/0101095 (priority Mar. 16, 2007), provides a knife comprised of a handle and a blade. The blade may further be formed so as to include a sharp edge, a sharp serrated edge, a non-sharp serrated edge and a gut hook. In certain embodiments, the handle may house a light source so the knife may be used in poorly lit environments and/or in combination with a gun. A power source may be housed inside of the handle and the handle may also include a dome switch to operate the light source. Sufficient sealant is placed in strategic locations throughout the handle so as to make the knife of certain embodiments of the present invention water resistant.

Most of these inventions secure the bayonet or other accessory to the muzzle of the rifle with one or more clamps, which require a tool for removal. This creates a disadvantage, since the user may need to remove the bayonet or other accessory quickly or may not have the tool available. When crawling or walking under overhead obstructions such as barbed wire, underbrush or low-hanging branches, quick and effortless removal of such an accessory may be critical.

The present invention, which provides a quick release bayonet mount which does not require tools, and will accommodate other accessories such as a bipod or laser sight, resolves the disadvantages of the prior art and is not anticipated by the prior art. A universal mount for a folding bayonet, featuring locking side rails for additional attachments, would resolve this problem.

SUMMARY OF THE INVENTION

Accordingly, the invention is directed to a picatinny/weaver style rail for a folding bayonet. The mount provides a cradle with set screws for affixing the bayonet to the mount. The mount can be affixed to any rifle, automatic weapon, shotgun, or other long firearm that has a picatinny/weaver style rail. Below the cradle, a rail bracket provides a main bolt for the bracket which may be secured with an Allen wrench and released with one hand. On the left side and the right side of the mount, picatinny rails are provided for securing a flashlight, sighting laser, bipod, or other attachments.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Figure 1:
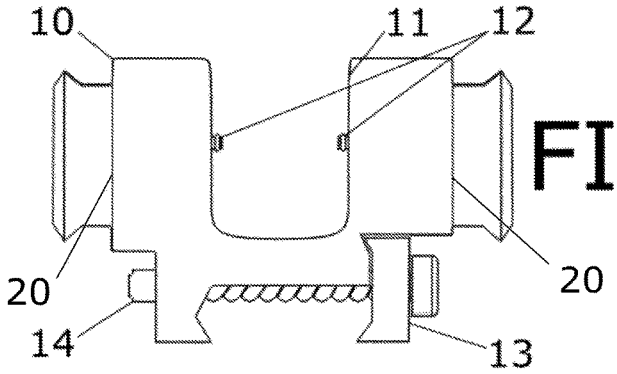
FIG. 1 is a front view of the first exemplary embodiment, displaying the mount 10, the cradle 11, the set screws 12, the rail bracket 13, and the main bolt 14.
Figure 2:
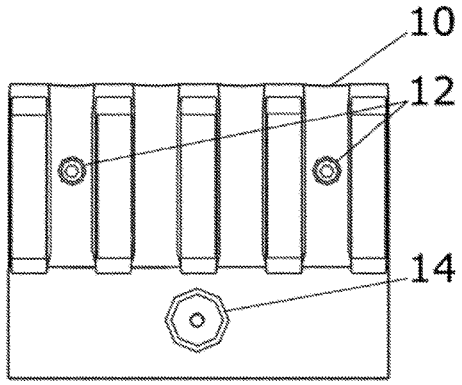
FIG. 2 is a side view of the first exemplary embodiment, displaying the mount 10, the set screws 12, and the main bolt 14.
Figure 3:
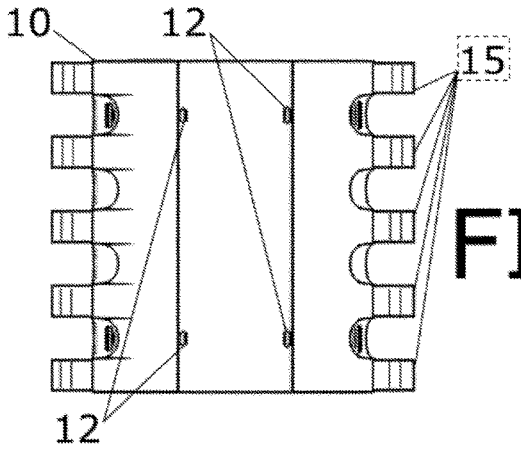
FIG. 3 is a top view of the first exemplary embodiment, displaying the mount 10, the set screws 12, and the side rails 15.
Figure 4:
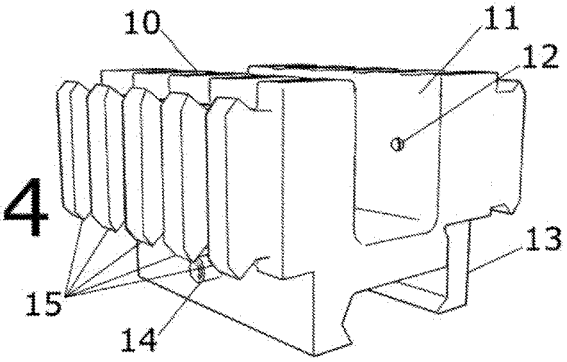
FIG. 4 is a side perspective view of the first exemplary embodiment, displaying the mount 10, the cradle 11, a set screw 12, the rail bracket 13, the main bolt 14, and the side rails 15.
Figure 5:
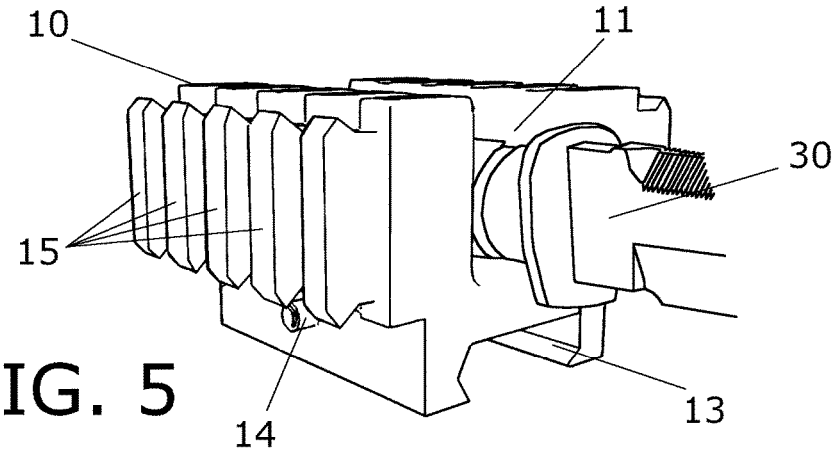
FIG. 5 is a side perspective view of the first exemplary embodiment, displaying the mount 10, the cradle 11, a set screw 12, the rail bracket 13, the main bolt 14, the side rails 15, and the bayonet 30.
Figure 6:
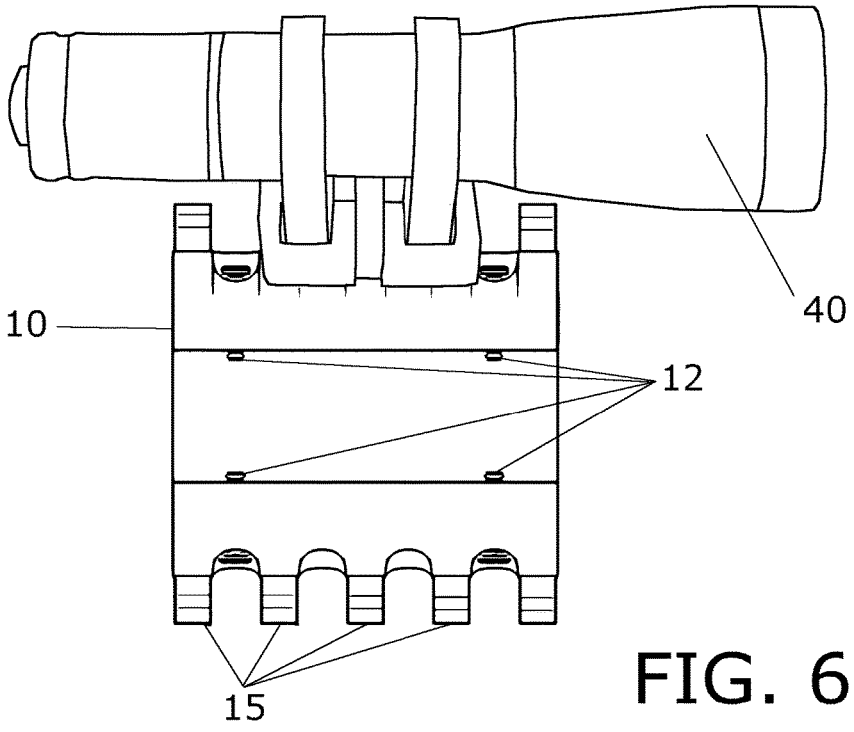
FIG. 6 is a top view of the first exemplary embodiment, displaying the mount 10, the set screws 12, the side rails 15, and the attachment 40.

Referring now to the invention in more detail, the invention is directed to a universal mount 10 for a folding bayonet.

The first exemplary embodiment is comprised of a mount 10 for a folding bayonet. The mount 10 provides a cradle 11 with four Allen key set screws 12, to secure the bayonet 30. Opposite the cradle 11, the rail bracket 13 provides a main bolt 14 for affixing the mount 10 to a picatinny/weaver rail on the barrel of an automatic weapon, shotgun, rifle, or other long firearm. The mount 10 may be quickly released with one hand using a mechanism which is well known, i.e. quick release, and may be tightened or loosened with an Allen key. On the sides 20 of the mount 10, side rails 15 are provided for securing other attachments 40, such as a flashlight, sighting laser, or bipod.

The mount 10 is designed for simplicity, sturdiness, versatility, and ease of installation and operation. A broad variety of attachments 40 may be easily affixed and removed without tools, using the side rails 15. Attachments 40 which fit the side rails 15, such as a flashlight, a sighting laser, a two-piece bipod, a smoke projector for concealment purposes, and a rifle grenade launcher, may be made available.

To use the first exemplary embodiment, the user may secure the cradle 11 of the mount 10 to the rail of the rifle, or other long firearm near the muzzle, using the main bolt 14 which is provided. Knives and bayonets 30 of various sizes may be used, turning the set screws 12 as necessary to secure the knife or bayonet 30. The user may then secure a folding bayonet 30 or similar blade weapon in the bayonet cradle 11, tightening the set screws 12 with an Allen key. The bayonet 30 may be removed with one hand as needed by turning the set screws 12 counterclockwise by hand.

Other attachments 40, such as a flashlight or sighting laser, may be affixed using the side rails 15 which are provided. The user places the attachment 40 above and to one side of the mount 10, such that each of the side rails 15 is aligned with the corresponding grooves on the attachment 40, then presses downward firmly on the attachment 40 until a clicking sound is heard, indicating that the attachment 40 has been secured in position. Some attachments 40 may require the use of an Allen key.

The mount 10 is preferably manufactured from a rigid, durable material which is lightweight and corrosion resistant, such as cast aluminum alloy. The set screws 12 and the main bolt 14 are preferably manufactured from a rigid, durable material with substantial structural strength which is corrosion resistant, such as aluminum alloy or stainless steel.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A mount for a folding bayonet, comprising a cradle having a plurality of screws extending within the cradle such that an item may be secured within the cradle; a rail bracket having a main bolt; said rail bracket being opposite said cradle; said rail bracket being configured to attach said mount to a picatinny or weaver rail on a barrel of a firearm; said main bolt secures the rail bracket to the picatinny or weaver rail.

2. The mount of claim 1, further comprising a knife or bayonet; said knife or bayonet being attached to said mount within said cradle; said plurality of screws being tightened to secure said knife or bayonet.

3. The mount of claim 1, wherein said main bolt is configured to quick release said mount from said firearm.

4. The mount of claim 2, wherein said main bolt is configured to quick release said mount from said firearm.

5. The mount of claim 1, further comprising at least one side rail; said at least one side rail being provided on a side of the mount.

6. The mount of claim 5, wherein said at least one side rail is sized and shaped such that other attachments may be attached.

7. The mount of claim 6, wherein an attachment configured to fit the side rail is attached to said at least one side rail; said attachment being one of a flashlight, sighting laser, bipod, smoke projector, or a rifle grenade launcher.

8. The mount of claim 5, wherein said at least one side rail is two side rails; said two side rails being provided on both sides of the mount.

9. The mount of claim 8, wherein said two side rails are sized and shaped such that other attachments may be attached.

10. The mount of claim 9, wherein at least one attachment configured to fit the side rail is attached to one of said two side rails; said attachment being one of a flashlight, sighting laser, bipod, smoke projector, or a rifle grenade launcher.

11. The mount of claim 9, wherein two attachments configured to fit the two side rails are attached to each of said two side rails; said each of the two attachments is one of a flashlight, sighting laser, bipod, smoke projector, or a rifle grenade launcher.

12. The mount of claim 2, further comprising at least one side rail; said at least one side rail being provided on a side of the mount.

13. The mount of claim 12, wherein said at least one side rail is sized and shaped such that other attachments.

14. The mount of claim 13, wherein an attachment configured to fit the side rail is attached to said at least one side rail; said attachment being one of a flashlight, sighting laser, bipod, smoke projector, or a rifle grenade launcher.

15. The mount of claim 13, wherein said at least one side rail is two side rails; said two side rails being provided on both sides of the mount.

16. The mount of claim 15, wherein said two side rails are sized and shaped such that other attachments.

17. The mount of claim 16, wherein at least one attachment configured to fit the side rail is attached to one of said two side rails; said at least one attachment being one of a flashlight, sighting laser, bipod, smoke projector, or a rifle grenade launcher.

18. The mount of claim 1, wherein said plurality of screws are allen screws and equal to four in number.

19. The mount of claim 2, wherein said plurality of screws are allen screws and equal to four in number.

* * * * *